US007575560B2

(12) United States Patent
Mizuuchi

(10) Patent No.: US 7,575,560 B2
(45) Date of Patent: Aug. 18, 2009

(54) FOOT MASSAGING APPARATUS WITH ROTATABLE ROLLER AND TOE PINCHING UNIT

(75) Inventor: Akihiro Mizuuchi, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 622 days.

(21) Appl. No.: 11/236,497

(22) Filed: Sep. 28, 2005

(65) Prior Publication Data

US 2006/0111654 A1 May 25, 2006

(51) Int. Cl.
*A61H 1/02* (2006.01)
*A61H 15/00* (2006.01)
*A61H 23/04* (2006.01)

(52) U.S. Cl. ..... 601/27; 601/29; 601/115; 601/118; 601/133; 601/152

(58) Field of Classification Search ..... 601/27–34, 601/97, 98, 99, 101, 102, 104, 115, 116, 601/118, 122, 126, 127, 128, 131, 133, 134, 601/136, 151, 152; 602/13
See application file for complete search history.

(56) References Cited

U.S. PATENT DOCUMENTS 2,030,358 A * 2/1936 Dorrance ..... 601/29
2,041,693 A * 5/1936 Boltz et al. ..... 601/28
2,114,322 A * 4/1938 Shafer ..... 601/29
2,223,263 A * 11/1940 Michaelson ..... 601/128
2,230,890 A * 2/1941 McClenathen ..... 601/122
2,250,493 A * 7/1941 Milne ..... 601/27
2,255,066 A * 9/1941 Lamb ..... 601/29
2,397,428 A * 3/1946 Moshier ..... 601/27
2,513,197 A * 6/1950 Moshier ..... 601/27
5,520,622 A * 5/1996 Bastyr et al. ..... 602/13

FOREIGN PATENT DOCUMENTS

JP 11-239595 9/1999
JP 2001-149425 6/2001
JP 2003-052781 2/2003

* cited by examiner

*Primary Examiner*—Danton DeMille
(74) *Attorney, Agent, or Firm*—Greenblum & Bernstein, P.L.C.

(57) ABSTRACT

Disclosed is a foot massaging apparatus, which comprises a housing for supporting user's foot, a rotatable roller unit mounted on the housing, and a toe-region pinching unit mounted on the housing and located in front of the rotatable roller unit. The toe-region pinching unit has an air cell adapted to be inflated and deflated, respectively, by charging and discharging air thereto and therefrom, so as to repeatedly pinch the toe region of the user's foot. The foot massaging apparatus can repeatedly perform a pressing operation for the foot or other leg region using the rotatable roller unit and a massaging operation for the toe region to prevent the user from getting bored.

20 Claims, 16 Drawing Sheets

FIG. 24A
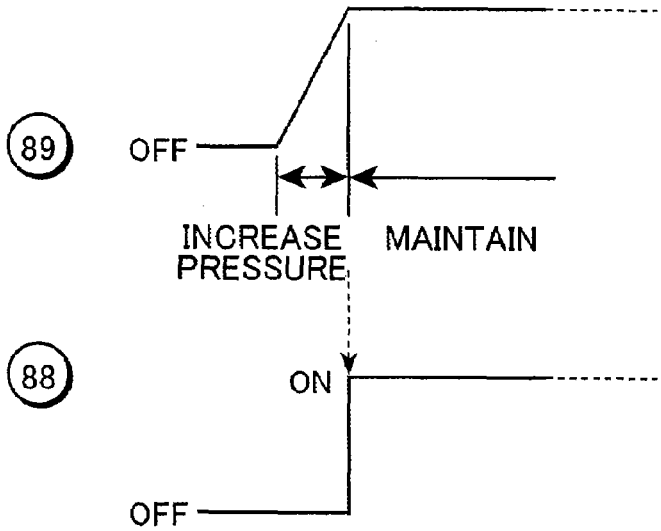
FIG. 24B
FIG. 25
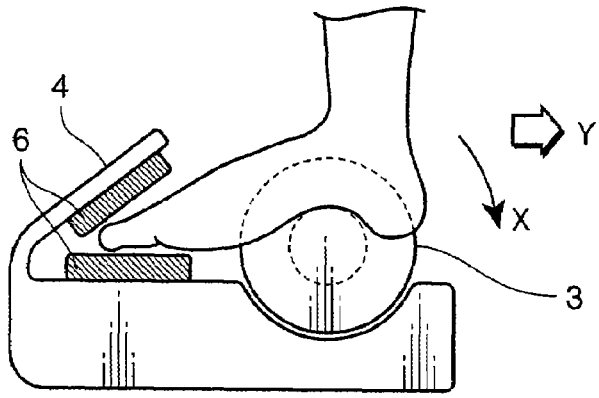

FOOT MASSAGING APPARATUS WITH ROTATABLE ROLLER AND TOE PINCHING UNIT

BACKGROUND OF THE INVENTION

1. Field of the Invention

The present invention relates to a foot massaging apparatus for massaging the foot or calf of a user.

2. Description of the Related Art

Heretofore, there have been known various foot massaging apparatuses as shown, for example, in FIG. 26 [see Japanese Patent Laid-Open Publication No. 15-052781 (Patent Publication 1)] and FIG. 27 [see Japanese Patent Laid-Open Publication No. 11-239595 (Patent Publication 2)].

In the conventional foot massaging apparatus illustrated in FIG. 26, a rotatable roller unit 101 having two grooves 102 for receiving therein right and left feet of a user is mounted to a foot-supporting housing 100 in a rotatably driven manner. Each of the grooves 102 has a width changing in a circumferential direction of the rotatable roller unit 101, and includes a plurality of pressing fingers 103 disposed on both sides thereof. When a user inserts his/her foot into the groove 102, the pressing fingers 103 located on both sides of a narrow portion of the groove 102 can pinch the foot therebetween in a width direction and pressingly massage the foot.

In the conventional foot massaging apparatus illustrated in FIG. 27, a rotatable roller unit 111 to be rotatably driven is mounted to a foot-supporting housing 110, and a plurality of drum-shaped pressing members 112 disposed in a circumferential direction of the rotatable roller unit 111 can pressingly massage right and/or left feet bottoms or leg calves. Further, a gate-shaped support member 114 is attached to the foot-supporting housing 110 in such a manner to be swingably moved between upstanding and fallen positions in a forward/backward direction of the foot-supporting housing 110. After holding the support member 114 at a given angle, an airbag attached onto an inner surface of the support member 114 can be inflated to press a user's foot toward the rotatable roller unit 111.

While the above conventional foot massaging apparatuses are designed to allow user's feet or other leg region to repeatedly receive a pressing operation from the rotatable roller unit, the pressing operation provides only mechanical rotational stimulations, and thereby a user is apt to get bored easily. Moreover, these apparatuses cannot perform a massaging operation for the toe region of user's foot. Thus, there remain problems to be improved.

SUMMARY OF THE INVENTION

It is therefore an object of the present invention to provide a foot massaging apparatus which can solve the above conventional problems.

It is another object of the present invention to provide a foot massaging apparatus capable of repeatedly performing a pressing operation for the foot or other leg region of a user using a rotatable roller unit and a massaging operation for the toe region of the user to prevent the user from getting bored.

According to an aspect of the present invention, a foot massaging apparatus is provided with a housing for supporting user's foot, a rotatable roller unit mounted on the housing. Further, a toe-region pinching unit is mounted on the housing and located in front of the rotatable roller unit. The toe-region pinching unit has an air cell adapted to be inflated and deflated, respectively, by charging and discharging air thereto and therefrom, so as to repeatedly pinch the toe region of the user's foot.

Other features and advantages of the present invention will be apparent from the accompanying drawings and from the detailed description.

BRIEF DESCRIPTION OF THE DRAWINGS

FIGS. 24A and 24B are diagrams showing a control action according to the flow chart in FIG. 23.

FIG. 25 is an explanatory side view showing a massaging operation using the foot massaging apparatus in FIG. 21.

DETAILED DESCRIPTION OF THE PREFERRED EMBODIMENTS OF THE INVENTION

Preferred embodiments of the present invention will now be specifically described with reference to the drawings.

First Embodiment

Figure 1:
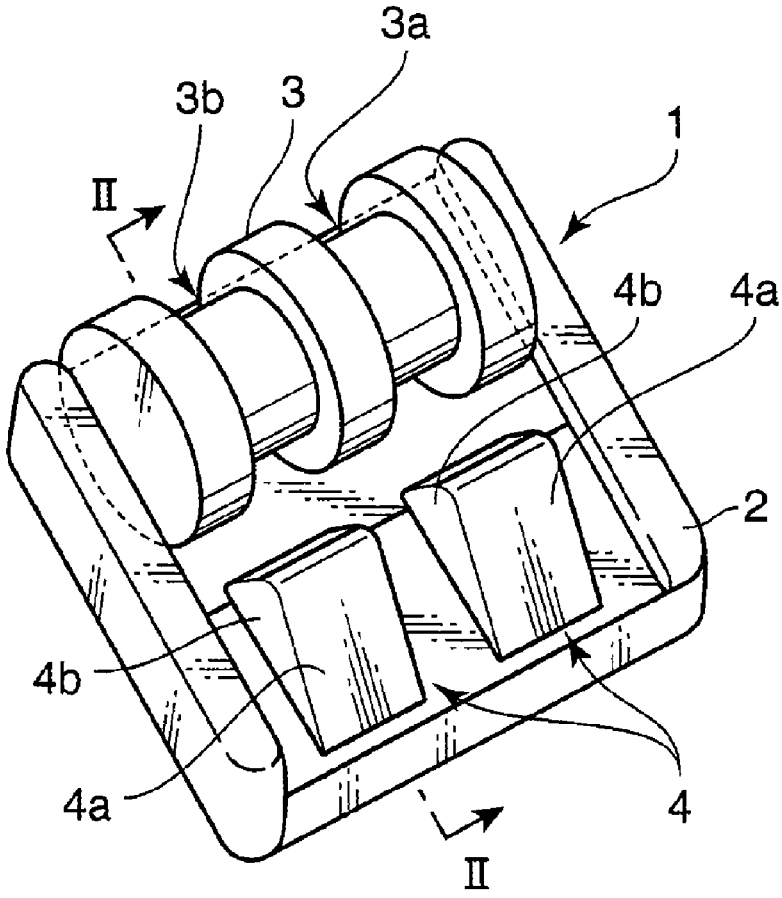
FIG. 1 is a perspective external view showing a foot massaging apparatus according to a first embodiment of the present invention.
Figure 2:
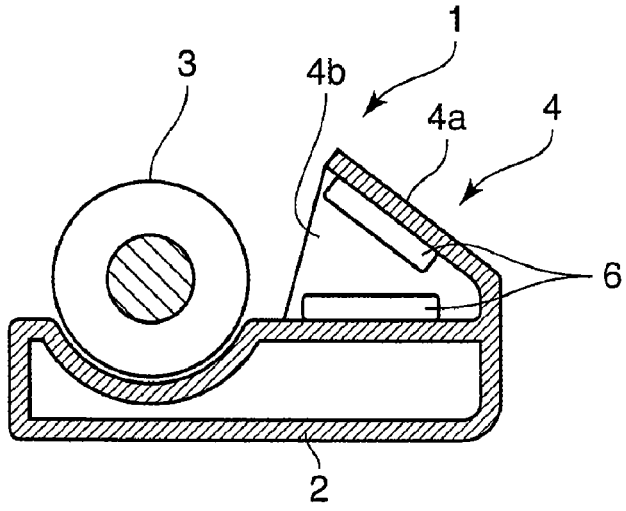
FIG. 2 is a sectional view taken along the line II-II in FIG. 1.

FIG. 1 is a perspective external view showing a foot massaging apparatus according to a first embodiment of the present invention, and FIG. 2 is a sectional view taken along the line II-II in FIG. 1.

This foot massaging apparatus 1 comprises a housing 2 for supporting the foot of a user, a rotatable roller unit 3, and a toe-region pinching unit 4. The rotatable roller unit 3 and the toe-region pinching unit 4 are mounted on a top surface of the housing 2. The rotatable roller unit 3 is located in a rear region of the housing 2, and the toe-region pinching unit 4 is located in front of the rotatable roller unit 3.

The rotatable roller unit 3 may have any suitable structure capable of repeatedly performing a pressing operation for the foot or feet of a user. For example, the rotatable roller unit 3 may be one selected from conventional rotatable roller units including the rotatable roller units as disclosed in the aforementioned Patent Publications 1 or 2. The rotatable roller unit 3 is designed to allow a user to place his/her left foot and right foot, respectively, on a left (right side in FIG. 1) portion 3*a* and a right (left side in FIG. 1) portion 3*b* thereof.

In this embodiment, the foot massaging apparatus 1 includes two of the toe-region pinching units 4. Each of the toe-region pinching units 4 is integrally mounted on or integrally formed with the housing 2. One of the toe-region pinching units 4 is disposed in front (lower side in FIG. 1) of the left portion 3*a*, and the other toe-region pinching unit 4 is disposed in front of the right portion 3*b*. Each of the toe-region pinching units 4 is formed in a sectionally V shape having an opening at a rear (upper side in FIG. 1) end thereof. More specifically, the toe-region pinching unit 4 has a front end wall connected to the top surface of the housing 2, a roof wall 4*a* extending obliquely upward and backward from the front end wall to form an opening, and opposite right and left side walls 4*b* extending vertically downward respectively, from right and left edges of the roof wall 4*a* to the top surface of the housing 2. Thus, a user can insert his/her toe region into the toe-region pinching unit 4 through the rear opening in the forward direction. Two air cells 6 are attached, respectively, on a bottom surface of the roof wall 4*a* and a portion of the top surface of the housing 2 covered by the roof wall 4*a*. Each of the air cells 6 is designed to be inflated and deflated, respectively, by charging and discharging air thereto and therefrom. The air cell 6 may be a bag made of rubber.

Figure 3:
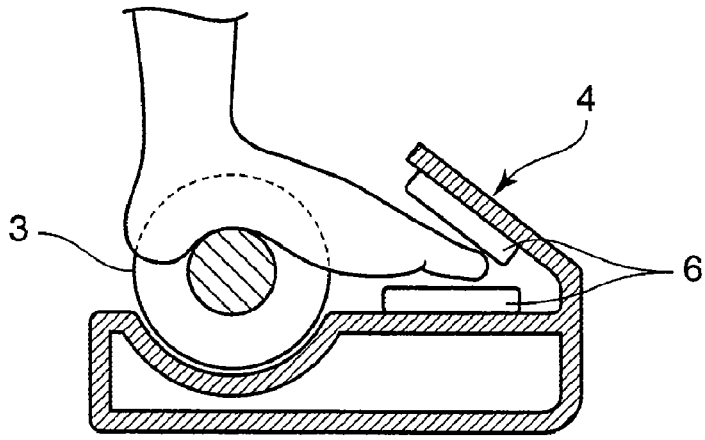
FIG. 3 is an explanatory sectional side view showing a massaging operation using the foot massaging apparatus in FIG. 1.

As shown in FIG. 3, in the foot massaging apparatus 1 having the above structure, when an air is supplied to the air cells 6 of the toe-region pinching unit 4, the air cells 6 are inflated to pinch therebetween the toe region inserted into the toe-region pinching unit 4. Then, when the air is discharged from the air cells 6, the air cells 6 are deflated to come free from the toe region or allow the toe region to be released from the air cells 6.

Thus, the foot massaging apparatus 1 according to the first embodiment can repeatedly perform a pressing operation for the bottoms of the user's feet using the rotatable roller unit 3 while performing a massaging operation for the toe regions of the user's feet using the toe-region pinching unit 4, so as to prevent the user from getting bored.

Second Embodiment

Figure 4:
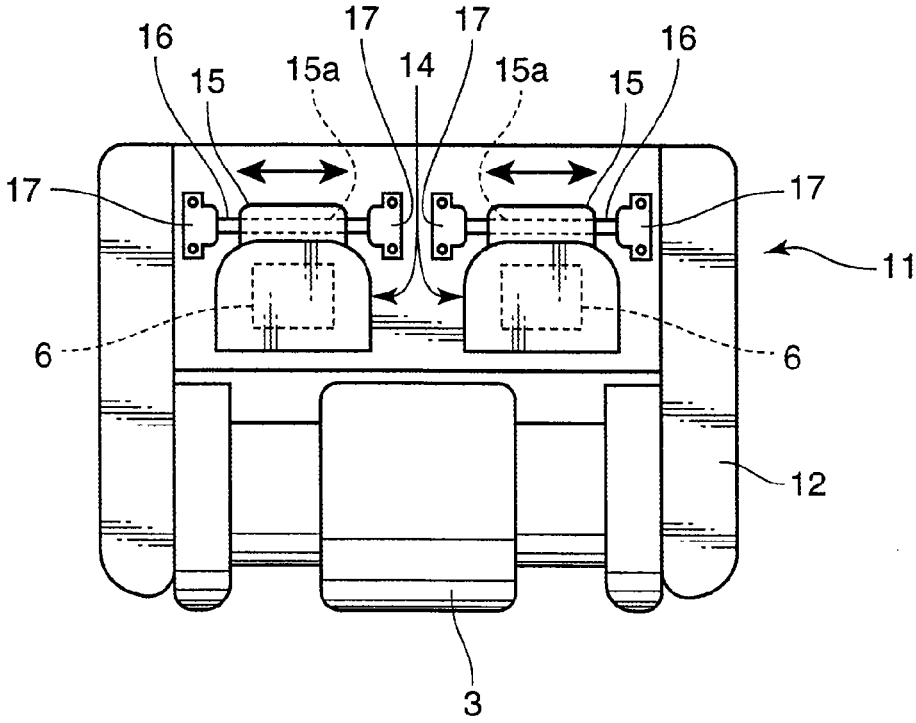
FIG. 4 is a top plan view showing a foot massaging apparatus according to a second embodiment of the present invention.
Figure 5:
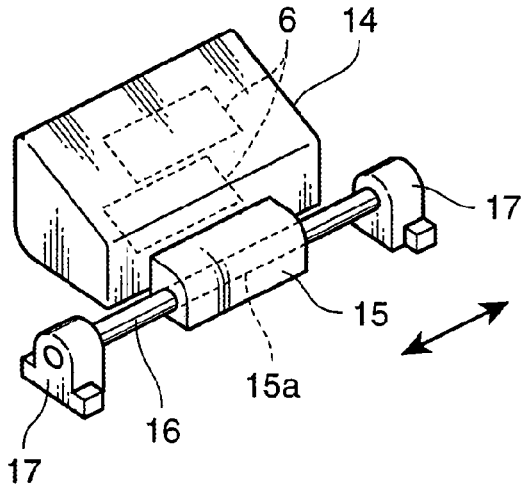
FIG. 5 is a front perspective view showing a toe-region pinching unit of the foot massaging apparatus in FIG. 4.

FIG. 4 is a top plan view showing a foot massaging apparatus according to a second embodiment of the present invention, and FIG. 5 is a front perspective view showing a toe-region pinching unit of this foot massaging apparatus. In this embodiment and after-mentioned embodiments, the same component as that in the first embodiment is defined by the same reference numeral.

In this foot massaging apparatus 11, a rotatable roller unit 3 and a pair of toe-region pinching units 14 are disposed on a housing 12 for supporting the foot or feet of a user, in the same positional relationship as that in the first embodiment. The rotatable roller unit 3 has the same structure as the rotatable roller unit in the first embodiment.

In this embodiment, the pair of toe-region pinching units 14 are formed separately from the housing 12, and disposed, respectively, on right and left regions of a top surface of the housing 12 in such a manner that each of the toe-region pinching units 14 is slidably moved independently in a rightward/leftward or lateral direction (indicated by the arrow) of the housing 12. The detailed structures of the toe-region pinching unit 14 and a slide mechanism thereof will be described below.

Each of the toe-region pinching units 14 has a toe-region insertion opening at a rear end thereof. Further, a pair of air cells 6 adapted to be inflated and deflated, respectively, by charging and discharging air thereto and therefrom, are attached, respectively, onto upper and lower surfaces defining an inner space of the toe-region pinching unit 14.

A pair of slide mechanisms are operatively associated, respectively, with the toe-region pinching units 14 independently, and disposed in front of the corresponding toe-region pinching units 14. Each of the slide mechanisms comprises a support portion 15 having a support hole 15*a* penetrating the inside thereof in a horizontal direction, a shaft 16 inserted through the support hole 15*a* to extend horizontally while aligning an axis thereof with the aforementioned lateral direction, and a pair of bearing stands 17 for supporting opposite ends of the shaft 16. Thus, each of the toe-region pinching units 14 can be slid in the lateral direction (indicated by the arrow) independently along the corresponding shaft 16.

As above, in addition to the effect in the first embodiment, in the foot massaging apparatus 11 according to the second embodiment, each of the toe-region pinching units 14 can be slid in the lateral direction to adjust respective positions of the toe-region pinching units 14 in accordance with the lateral movements, depending on a distance between user's right and left feet.

As to the shaft 16, it is not essential to provide two shafts, respectively, in the two toe-region pinching units 14, and the toe-region pinching units 14 may have a single common shaft.

Third Embodiment

Figure 6:
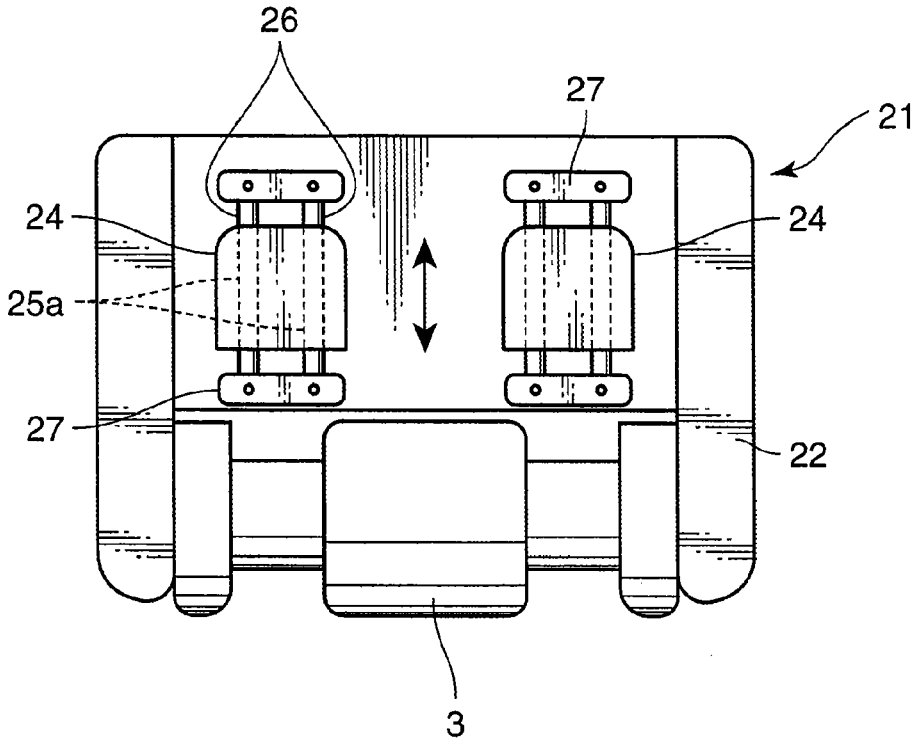
FIG. 6 is a top plan view showing a foot massaging apparatus according to a third embodiment of the present invention.
Figure 7:
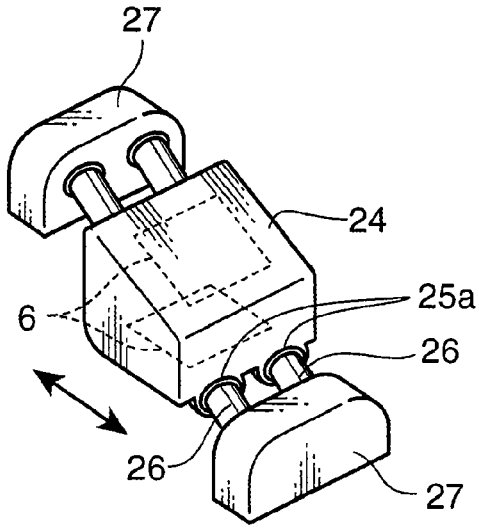
FIG. 7 is a front perspective view showing a toe-region pinching unit of the foot massaging apparatus in FIG. 6.

FIG. 6 is a top plan view showing a foot massaging apparatus according to a third embodiment of the present invention, and FIG. 7 is a front perspective view showing a toe-region pinching unit of this foot massaging apparatus.

In this foot massaging apparatus 21, a rotatable roller unit 3 and a pair of toe-region pinching units 24 are disposed on a housing 22 for supporting the foot or feet of a user, in the same positional relationship as that in the first embodiment. The rotatable roller unit 3 has the same structure as the rotatable roller unit in the first embodiment.

In this embodiment, the pair of toe-region pinching units 24 are formed separately from the housing 22, and disposed, respectively, on right and left regions of a top surface of the housing 22 in such a manner that each of the toe-region pinching units 24 is slidably moved independently in a forward/backward direction of the housing 22. The detailed structures of the toe-region pinching unit 24 and a slide mechanism thereof will be described below.

Each of the toe-region pinching units 24 has a toe-region insertion opening at a rear end thereof. Further, a pair of air cells 6 adapted to be inflated and deflated, respectively, by charging and discharging air thereto and therefrom, are attached, respectively, onto upper and lower surfaces defining an inner space of the toe-region pinching unit 24.

A pair of slide mechanisms are operatively associated, respectively, with the toe-region pinching units 24 independently, and disposed under the corresponding toe-region pinching units 24. Each of the toe-region pinching units 24 has a pair of support holes 25*a* each penetrating the inside thereof in a forward/backward direction (indicated by the arrow). Each of the slide mechanisms comprises a pair of shafts 26 each inserted through a corresponding one of the support holes 25*a* to extend horizontally while aligning an axis thereof with the aforementioned forward/backward direction, and a pair of bearing stands 27 for supporting opposite ends of each of the shafts 26. Thus, each of the toe-region pinching units 24 can be slid in the forward/backward direction independently along the corresponding pair of shafts 26.

As above, in addition to the effect in the first embodiment, in the foot massaging apparatus 21 according to the third embodiment, each of the toe-region pinching units 24 can be slid in the forward/backward direction to adjust respective positions of the toe-region pinching units 24 in accordance with the forward/backward movements, depending on user's foot size.

As to the shaft 26, it is not essential to provide two shafts in each of the toe-region pinching units 24, and each of the toe-region pinching units 14 may have a single flat shaft or may have three shafts or more.

Fourth Embodiment

Figure 8:
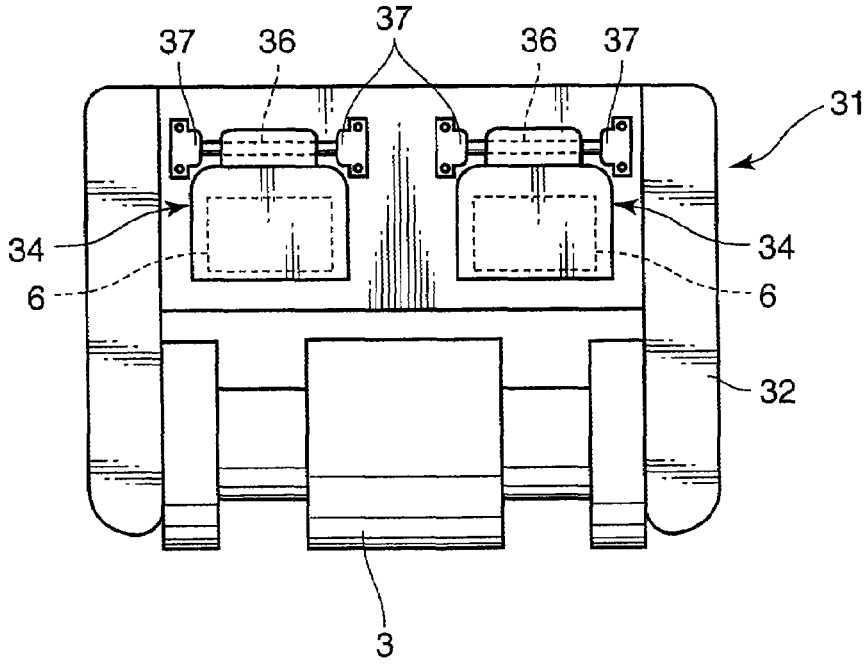
FIG. 8 is a top plan view showing a foot massaging apparatus according to a fourth embodiment of the present invention.
Figure 9:
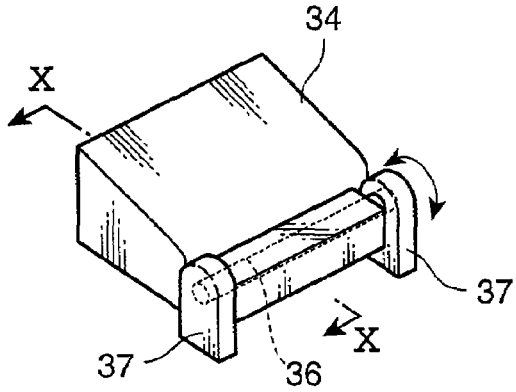
FIG. 9 is a front perspective view showing a toe-region pinching unit of the foot massaging apparatus in FIG. 8.
Figure 10:
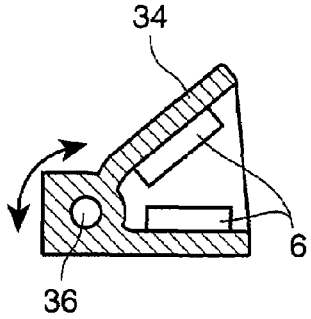
FIG. 10 is a sectional view taken along the line X-X in FIG. 9.

FIG. 8 is a top plan view showing a foot massaging apparatus according to a fourth embodiment of the present invention. FIG. 9 is a front perspective view showing a toe-region pinching unit of this foot massaging apparatus, and FIG. 10 is a sectional view taken along the line X-X in FIG. 9.

In this foot massaging apparatus 31, a rotatable roller unit 3 and a pair of toe-region pinching units 34 are disposed on a housing 32 for supporting the foot or feet of a user, in the same positional relationship as that in the first embodiment. The rotatable roller unit 3 has the same structure as the rotatable roller unit in the first embodiment.

In this embodiment, the pair of toe-region pinching units 34 are formed separately from the housing 32, and disposed, respectively, on right and left regions of a top surface of the housing 32 in such a manner that each of the toe-region pinching units 34 is swingably moved independently around a horizontal axis. The detailed structures of the toe-region pinching unit 34 and a swing mechanism thereof will be described below.

Each of the toe-region pinching units 34 has a toe-region insertion opening at a rear end thereof Further, a pair of air cells 6 adapted to be inflated and deflated, respectively, by charging and discharging air thereto and therefrom, are attached, respectively, onto upper and lower surfaces defining an inner space of the toe-region pinching unit 34.

A pair of swing mechanisms are operatively associated, respectively, with the toe-region pinching units 34 independently, and disposed in front of the corresponding toe-region pinching units 34. Each of the swing mechanisms comprises a shaft 36 extending horizontally while aligning an axis thereof with the aforementioned lateral direction, and a pair of bearing stands 37 for supporting opposite ends of the shaft 36. Each of the shafts 36 is fixedly connected to a front end portion of a corresponding one of the toe-region pinching units 34. Thus, each of the toe-region pinching units 34 can be swung around the corresponding horizontal shaft 36 defining a horizontal axis, independently in a direction indicated by the arrow (see FIG. 10).

As above, in addition to the effect in the first embodiment, in the foot massaging apparatus 31 according to the fourth embodiment, each of the toe-region pinching units 34 can be swung around the horizontal shaft 36 or horizontal axis to allow a user to readily insert his/her toe region into the toe-region pinching unit 14 in accordance with the swing movements.

Fifth Embodiment

Figure 11:
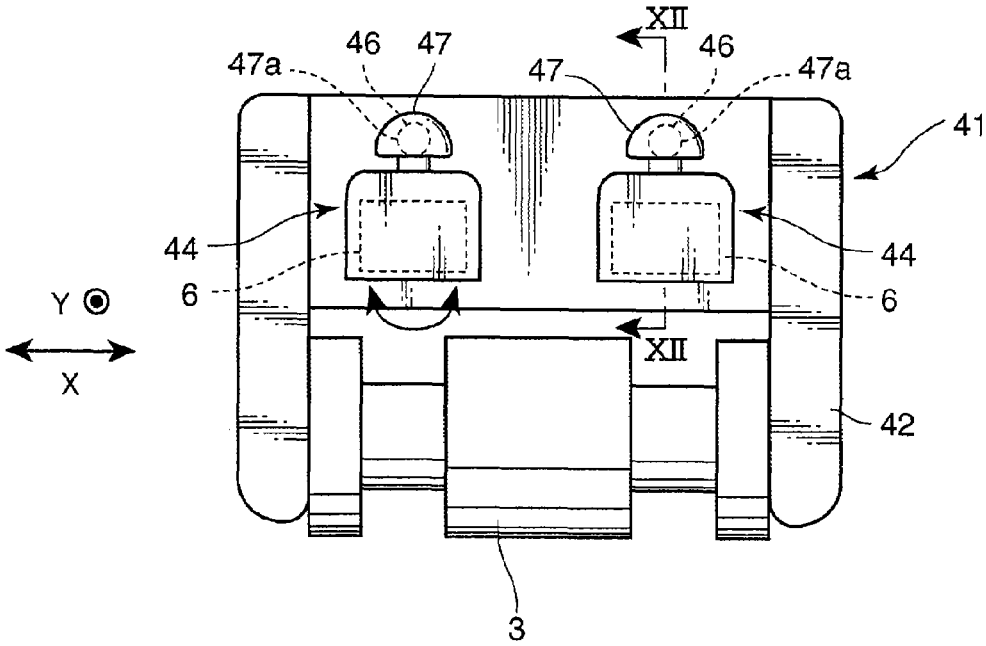
FIG. 11 is a top plan view showing a foot massaging apparatus according to a fifth embodiment of the present invention.
Figure 12:
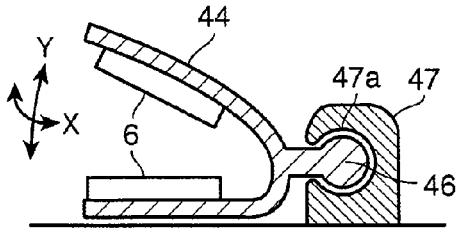
FIG. 12 is a sectional view taken along the line XII-XII in FIG. 11.

FIG. 11 is a top plan view showing a foot massaging apparatus according to a fifth embodiment of the present invention, and FIG. 12 is a sectional view taken along the line XII-XII in FIG. 11.

In this foot massaging apparatus 41, a rotatable roller unit 3 and a pair of toe-region pinching units 44 are disposed on a housing 42 for supporting the foot or feet of a user, in the same positional relationship as that in the first embodiment. The rotatable roller unit 3 has the same structure as the rotatable roller unit in the first embodiment.

In this embodiment, the pair of toe-region pinching units 44 are formed separately from the housing 42, and disposed, respectively, on right and left regions of a top surface of the housing 42 in such a manner that each of the toe-region pinching units 44 is swingably moved independently around a horizontal axis and a vertical axis. The detailed structures of the toe-region pinching unit 44 and a swing mechanism thereof will be described below.

Each of the toe-region pinching units 44 has a toe-region insertion opening at a rear end thereof. Further, a pair of air cells 6 adapted to be inflated and deflated, respectively, by charging and discharging air thereto and therefrom, are attached, respectively, onto upper and lower surfaces defining an inner space of the toe-region pinching unit 44.

Each of a pair of swing mechanisms is composed of a universal joint which comprises a spherical member 46 integrally connected to a front portion of a corresponding one of the toe-region pinching units 44 through a connection member 45, and a bearing stand 47 having a concave-shaped spherical receiving surface 47*a* for rotatably holding the spherical member 46. Thus, each of the toe-region pinching units 44 can be swung around a horizontal axis and a vertical axis (i.e. X direction and Y direction in FIGS. 11 and 12) independently through the universal joint.

As above, in addition to the effect in the first embodiment, in the foot massaging apparatus 41 according to the fifth embodiment, each of the toe-region pinching units 44 can be swung around the horizontal and vertical axes to allow a user to readily insert his/her toe region into the toe-region pinching unit 44 in accordance with the swing movements around the horizontal axis and to cope with a user whose toes point outward relative to the heel region or a user whose toes point inward relative to the heel region.

While the foot massaging apparatus 41 according to the fifth embodiment employs the spherical member 46 and the bearing stand 47 having the spherical receiving surface 47*a*, a combination of a first swing mechanism for a swing movement around a horizontal axis and a second swing mechanism for a swing movement around a vertical axis may be used to achieve the same effect.

Further, while each of the toe-region pinching units in the second to fourth embodiments is designed to perform either one of a slide movement in the lateral direction, a slide movement in the forward/backward direction and a swing movement around the horizontal axis, and the toe-region pinching unit in the fifth embodiment is designed to perform a swing movement around the horizontal and vertical axes, the present invention is not limited to such movements. Specifically, one or more of a slide mechanism for a slide movement in the lateral direction, a slide mechanism for a slide movement in the forward/backward direction, a swing mechanism for a swing movement around the horizontal axis and a swing mechanism for a swing movement around the vertical axis may be combined with each other. For example, the toe-region pinching unit may be designed to be slidably moved in the lateral and forward/backward directions and swingably moved around the horizontal and vertical axes.

Sixth Embodiment

Figure 13:
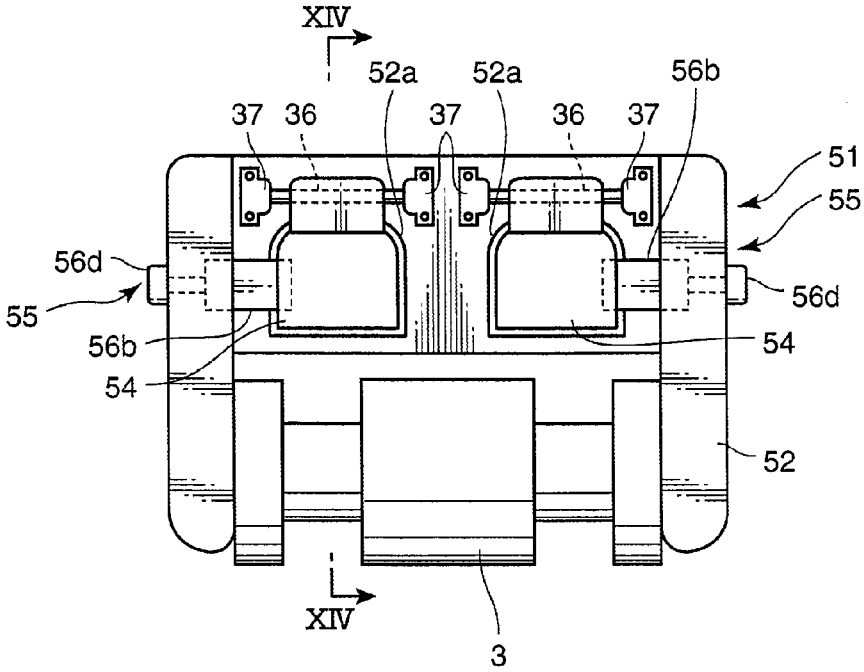
FIG. 13 is a top plan view showing a foot massaging apparatus according to a sixth embodiment of the present invention.
Figure 14:
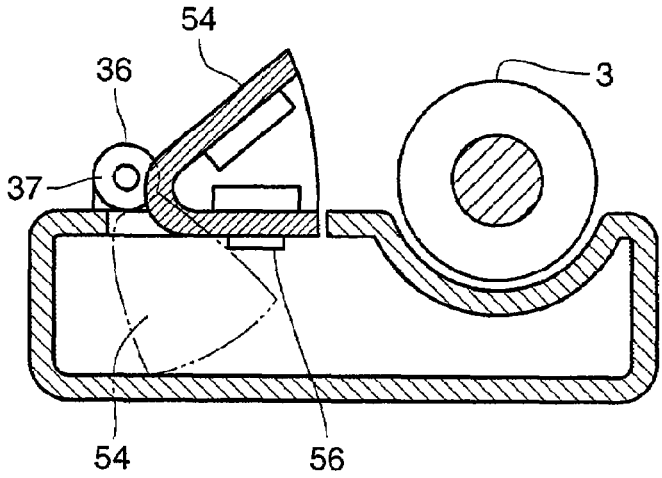
FIG. 14 is a sectional view taken along the line XIV-XIV in FIG. 13.
Figure 15:
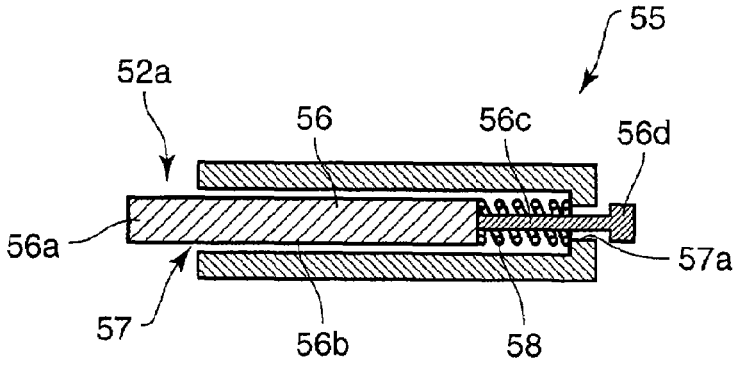
FIG. 15 is a sectional view showing a retention-releasing mechanism of the foot massaging apparatus in FIG. 8.

FIG. 13 is a top plan view showing a foot massaging apparatus according to a sixth embodiment of the present invention, and FIG. 14 is a sectional view taken along the line XIV-XIV in FIG. 13. FIG. 15 is a sectional view showing a retention releasing mechanism.

In this foot massaging apparatus 51, a rotatable roller unit 3 and a pair of toe-region pinching units 54 are disposed on a housing 52 for supporting the foot or feet of a user, in the same positional relationship as that in the first embodiment. The rotatable roller unit 3 has the same structure as the rotatable roller unit in the first embodiment. Further, the pair of toe-region pinching units 54 and a pair of swing mechanisms (a pair of shafts 36 and two pairs of bearing stands 37) thereof are identical to the toe-region pinching units 44 and the swing mechanisms in the fourth embodiment.

Differently from the fourth embodiment, the housing 52 has two cutout portions 52*a* formed, respectively, in right and left regions of a top wall thereof, to allow the toe-region pinching units 54 to be retracted into and extracted out of an inner space of the housing 52 therethrough. Further, the housing 52 is provided with a pair of retention releasing mechanisms 55 disposed, respectively, on the right side of the right cutout portion 52*a* and on the left side of the left cutout portion 52*a*.

Each of the retention releasing mechanisms 55 comprises a slidable member 56 having an inward end to be retractably moved into a corresponding one of the cutout portions 52*a*, a casing having therein a guide hole 57 for guiding the slidable member 56 in a lateral direction of the housing 52, and a coil spring 58 for applying an elastic pressing force to the slidable member 56 so as to allow the inward end 56*a* to protrude into the cutout portion 52*a*.

The slidable member 56 is generally formed in a plate-like shape which has a widened portion 56*b* formed on the side of the inward end 56*a* thereof, and a rod-shaped spring insertion portion 56*c* extending from an outward end of the widened portion 56*b* toward an outward end of the slidable member 56. The outward end of the spring insertion portion 56*c* or the slidable member 56 is formed as a knob 56*d* having a width greater than that of the spring insertion portion 56*c*. The inward end 56*a* of the slidable member 56 corresponds to an inward end of the widened portion 56*b*.

The casing of the retention releasing mechanism 55 also has an opening 57*a* continuous with an outward end of the guide hole 57 or one end of the guide hole 57 located on the opposite side of the opening 52*a*, and the spring insertion portion 56*c* is inserted through the opening 57*a*. The opening 57*a* has a size which allows the knob 56*b* to be brought into contact with an outer surface of the casing around the opening 57*a* so as to determine an inwardmost position of the slidable member 56.

Thus, when the knob 56*d* is gripped and pulled outward to slidingly move the inward end 56*a* of the slidable member 56 outside the cutout portion 52*a*, the toe-region pinching unit 54 can be retracted into or extracted out of the inner space of the housing 52 through the cutout portion 52*a*. More specifically, in an operation for extracting the toe-region pinching unit 54 stored in the inner space of the housing 52, out of the housing 52, and setting the toe-region pinching unit 54 at its use position, a user may pull the knob 56*d* outward and extract the toe-region pinching unit 54. Then, the user may take off the knob 56*d*, so that the inward end 56*a* of the slidable member 56 protrudes under the toe-region pinching unit 54 to retain the toe-region pinching unit 54 at the use position (see FIG. 14). Further, in an operation for retracting the toe-region pinching unit 54 into the inner space of the housing 52, a user may grip and pull the knob 56*d* outward to slidingly move the inward end 56*a* of the slidable member 56 outside the cutout portion 52*a* so as to drop the toe-region pinching unit 54 into the inner space of the housing 52 through the cutout portion 52*a*. In order to retain the toe-region pinching unit 54 at its stored position, the retention releasing mechanism 55 may be designed such that, when a user takes off the knob 56*d*, the inward end 56*a* of the, slidable member 56 protruding into the cutout portion 52*a* is located above the retracted toe-region pinching unit 54. Alternatively, the toe-region pinching unit 54*a* may be formed, but not shown, with a concave portion allowing the inward end 56*a* of the slidable member 56 to be fitted therein.

Seventh Embodiment

Figure 16:
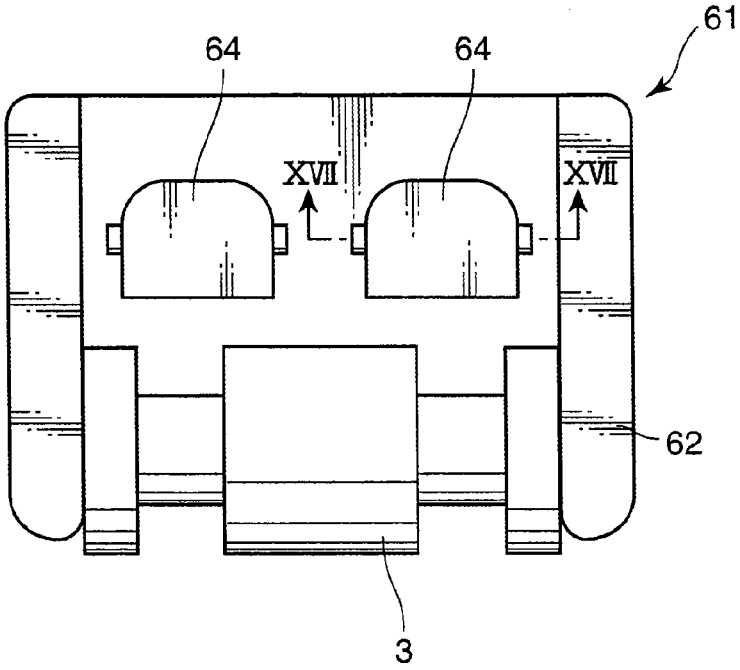
FIG. 16 is a top plan view showing a foot massaging apparatus according to a seventh embodiment of the present invention.
Figure 17:
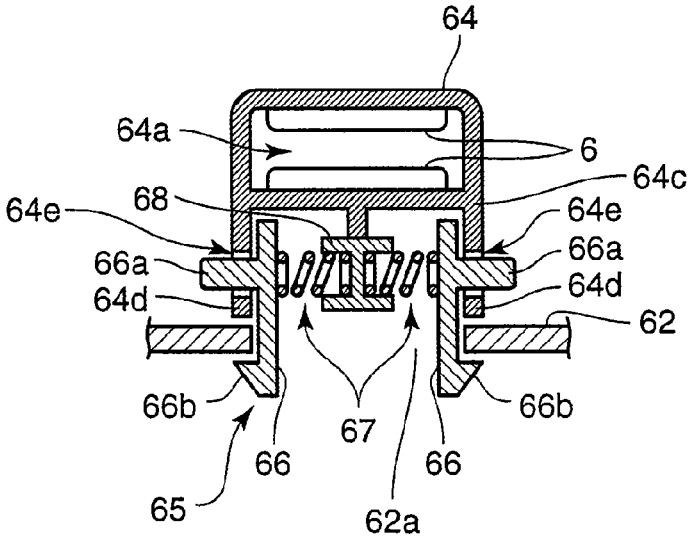
FIG. 17 is a sectional view taken along the line XVII-XVII in FIG. 16.

FIG. 16 is a top plan view showing a foot massaging apparatus according to a seventh embodiment of the present invention, and FIG. 17 is a sectional view taken along the line XVII-XVII in FIG. 16.

This foot massaging apparatus 61 includes a pair of toe-region pinching unit 64 each attached to a top wall of a housing 62 for supporting the foot or feet of a user, in a detachable manner through an attaching/detaching mechanism 65 operatively associated between the toe-region pinching unit 64 and the housing 62. In this foot massaging apparatus 61, a rotatable roller unit 3 and the toe-region pinching units 64 are disposed on the housing 62 in the same positional relationship as that in the first embodiment. The rotatable roller unit 3 has the same structure as the rotatable roller unit in the first embodiment.

Each of the toe-region pinching units 64 has a foot insertion portion 64*a* provided with a pair of air cells 6 attached, respectively, to upper and lower surfaces thereof, and an extension portion 64*c* extending downward from the foot insertion portion 64*a* to form a cavity therein. The extension portion 64*c* has a flat-shaped lower end which comes into contact with an upper surface of the top wall of the housing 62 around a mounting hole 62*a* formed in the top wall of the housing 62.

The attaching/detaching mechanism 65 comprises a pair of releasing members 66 disposed in the cavity of the extension portion 64*c*, two coil springs 67 for applying an elastic force to the corresponding releasing members 66 in the outward direction, and a support portion 68 supporting respective inward ends of the coil spring 67.

Each of the releasing member 66 has an outward extending protrusion 66*a* attached to a mounting hole 64*a* formed in a corresponding one of opposite side walls 64*a* of the toe-region pinching units 64, and an lower end formed as a hook 66*b* engageable with a lower surface of the top wall of housing 62 around the mounting hole 62*a*.

Thus, in an operation for detaching the toe-region pinching unit 64, a user may push the two protrusions 66*a* inward to come closer to one another so that the engagement between the hooks 66*a* and the lower surface around the mounting hole 62*a* is released. Then, the user may pull the toe-region pinching unit 64 upward. Further, in an operation for attaching the toe-region pinching unit 64 to its use position, a user may insert the extension portion 64*c* of the toe-region pinching unit 64 while pushing the two protrusions 66*a* inward to come closer to one another. Then, the user may take off the protrusions 66*a* to engage the hooks 66*b* with the lower surface around the mounting hole 62*a*.

Eighth Embodiment

Figure 18:
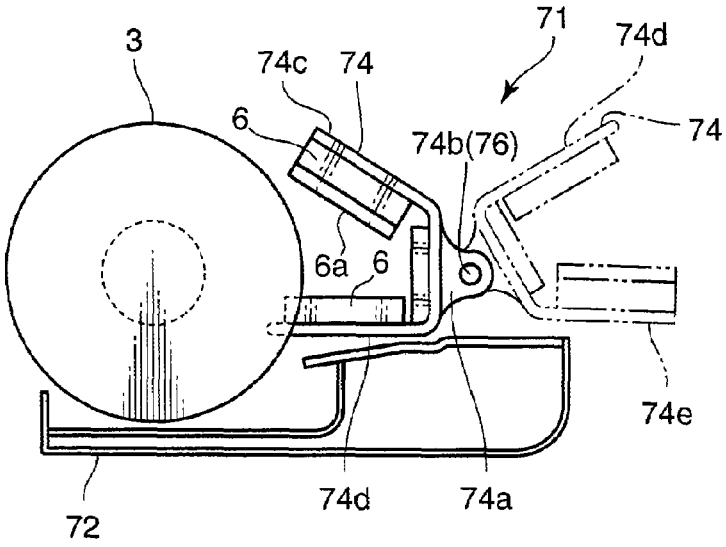
FIG. 18 is a side view showing a foot massaging apparatus according to an eighth embodiment of the present invention.
Figure 19:
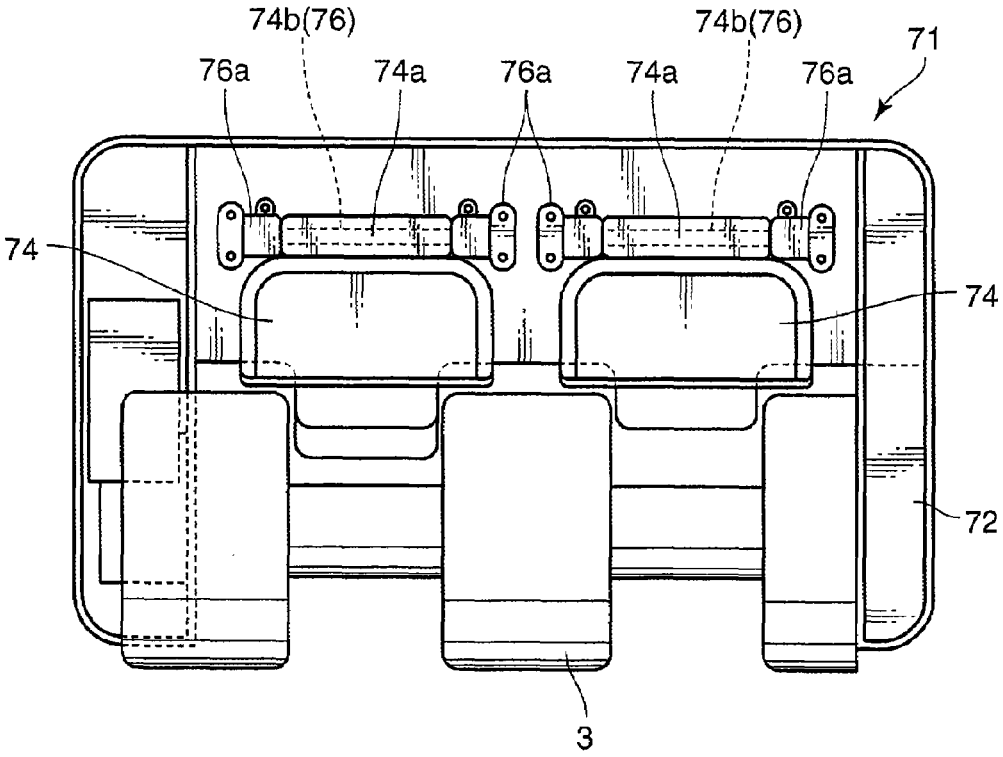
FIG. 19 is a top plan view of the foot massaging apparatus in FIG. 18.

FIG. 18 is a side view showing a foot massaging apparatus according to an eighth embodiment of the present invention, and FIG. 19 is a top plan view of this foot massaging apparatus.

This foot massaging apparatus 71 includes a pair of toe-region pinching units 74 each designed to be swingably moved around a horizontal axis to reverse top and bottom surfaces thereof so as to allow the reversed upward-facing bottom surface to serve as a footrest. In this foot massaging apparatus 71, a rotatable roller unit 3 and the toe-region pinching units 74 are disposed on a housing 72 for supporting the foot or feet of a user, in the same positional relationship as that in the first embodiment. The rotatable roller unit 3 has the same structure as the rotatable roller unit in the first embodiment.

Each of the toe-region pinching units 74 has a pair of air cells 6 attached onto upper and lower surfaces defining an inner space of the toe-region pinching units 74, and a front portion formed as a support portion 74*a*. The swing-support portion 74*a* is formed with a shaft hole 74*b* extending horizontally, and a shaft 76 is inserted through the shaft hole 74*b*. The shaft 76 has opposite ends horizontally supported, respectively, by a pair of bearings 76*a* fixed on a top surface of the housing 72. Thus, the toe-region pinching unit 74 can be swung around the shaft 76. When the toe-region pinching unit 74 is located on the backward side of the shaft 76, the toe-region pinching unit 74 is in a normal use position where the top surface faces upward, and the bottom surface faces downward. When the toe-region pinching unit 74 is located on the forward side of the shaft 76, the toe-region pinching unit 74 is in a reversed position where the top surface faces downward, and the bottom surface serving as a footrest faces upward.

Figure 20:
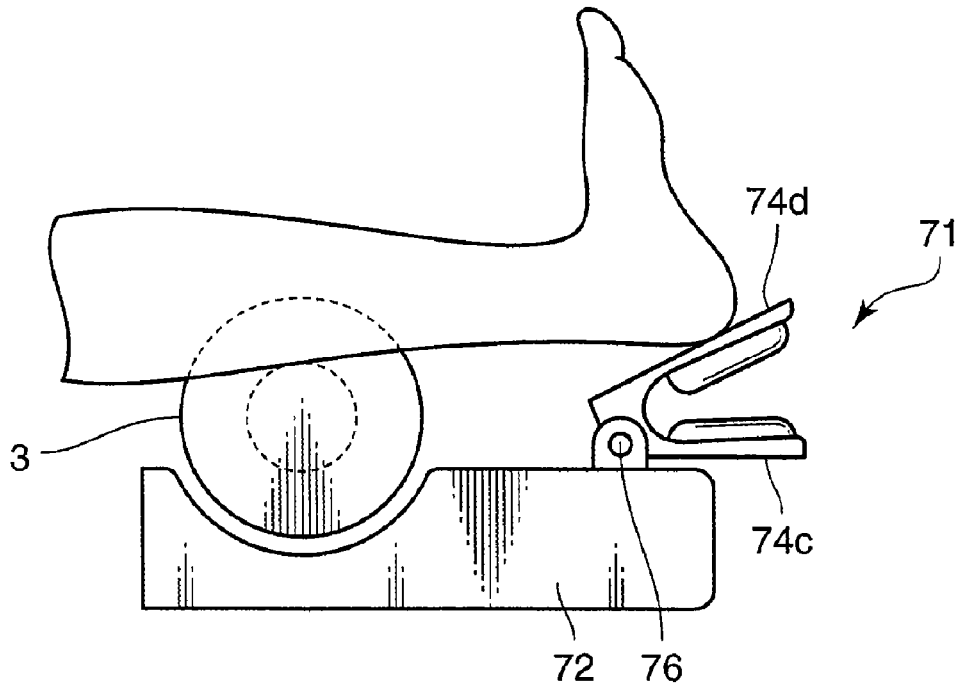
FIG. 20 is an explanatory side view showing a massaging operation using the foot massaging apparatus in FIG. 18.

As above, as shown in FIG. 20, according to the eighth embodiment, each of the toe-region pinching units 74 can be swung around the horizontal shaft 76 defining a horizontal axis to reverse the top and bottom surfaces thereof so as to allow the reversed upward-facing bottom surface 76*d* to serve as a footrest. In this state, a user may place his/her foot on the footrest formed by the bottom surface 74*d*, and have an massage operation for his/her calf region using the rotatable roller unit. In FIG. 18, the reference numeral 6*a* indicates a cushioning material attached on one of the air cells 6.

Ninth Embodiment

Figure 21:
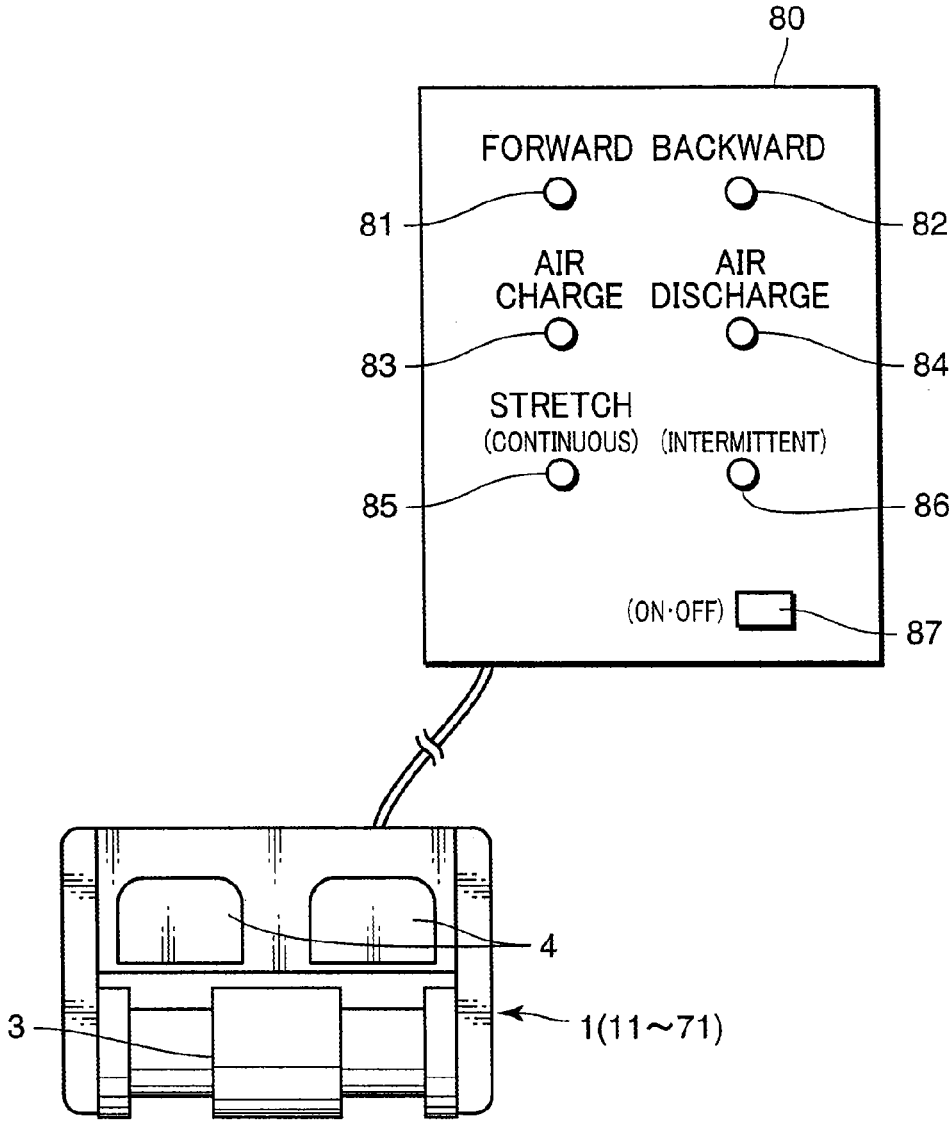
FIG. 21 is a schematic diagram showing a manual control unit equipped in a foot massaging apparatus according to a ninth embodiment of the present invention.
Figure 22:
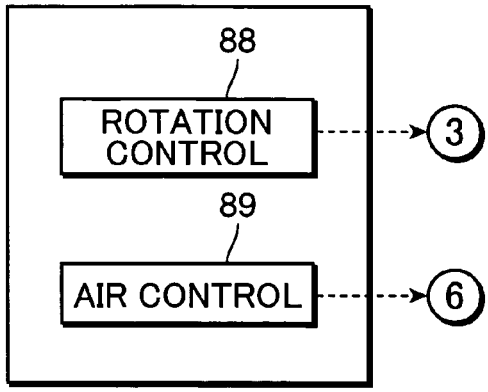
FIG. 22 is a block diagram showing a control section incorporated in the manual control unit in FIG. 21.
Figure 23:
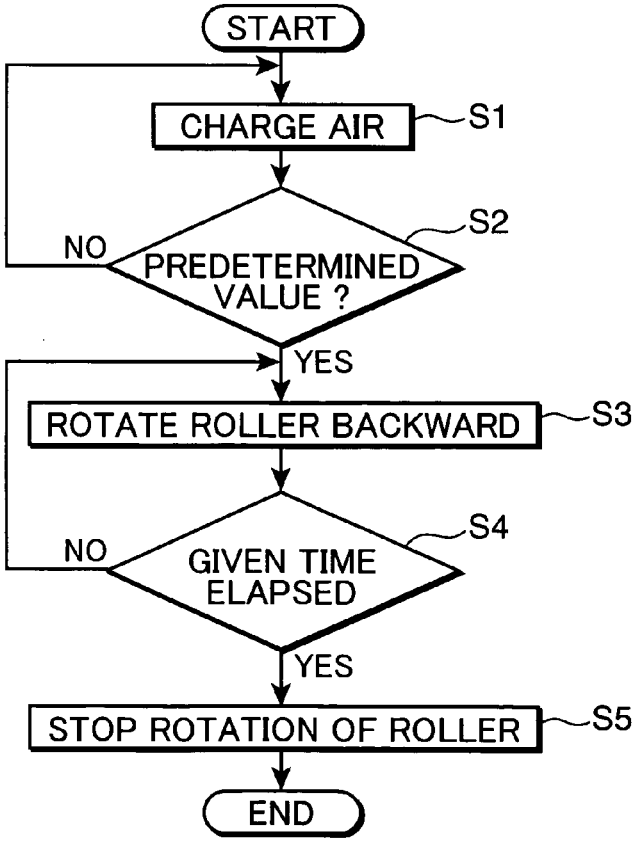
FIG. 23 is a flow chart showing a control process to be executed when a stretch (continuous) button of the manual control unit in FIG. 21 is selected.
Figure 26:
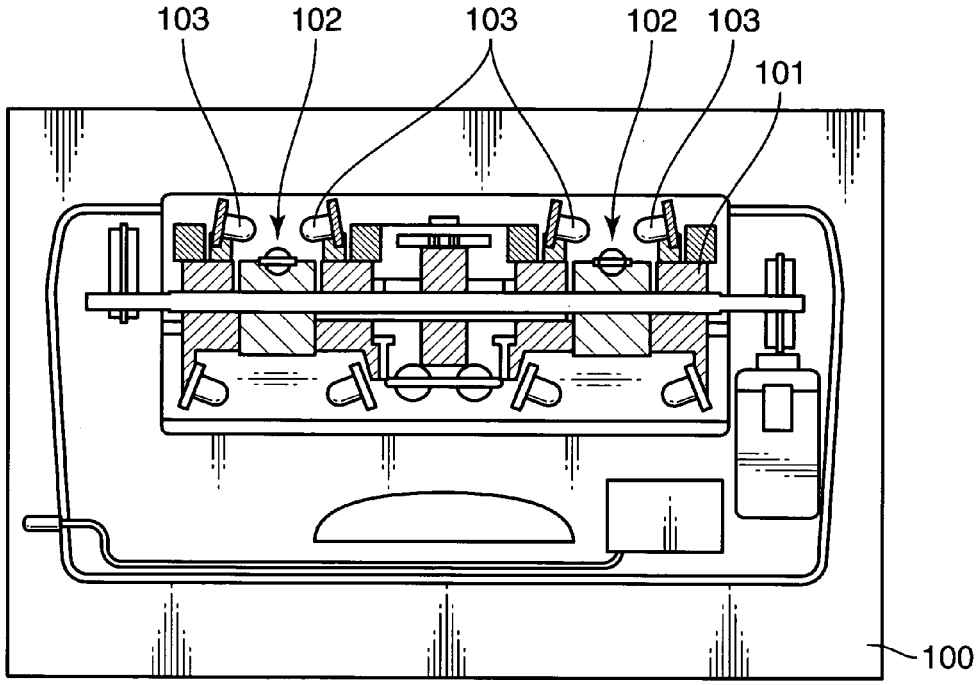
PRIOR ART FIG. 26
FIG. 26 is a sectional front view showing a conventional foot massaging apparatus.
Figure 27:
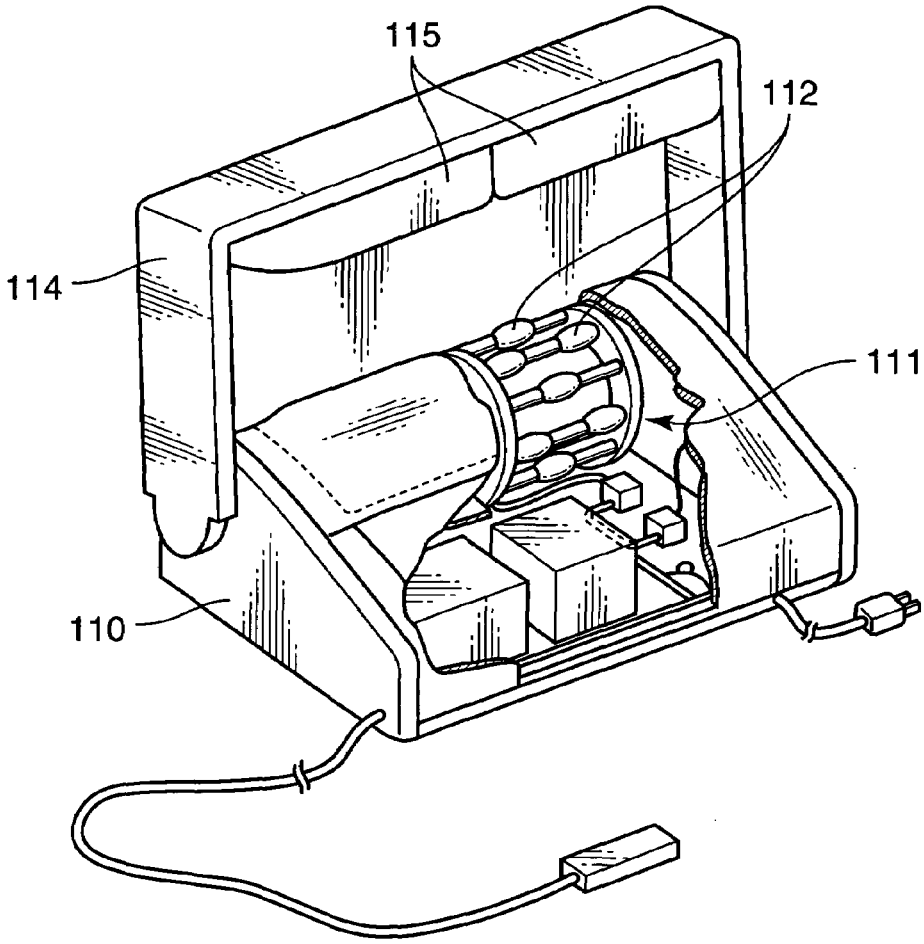
PRIOR ART FIG. 27
FIG. 27 is a partly cut-out perspective view showing another conventional foot massaging apparatus.

FIG. 21 is a schematic diagram showing a manual control unit equipped in a foot massaging apparatus according to a ninth embodiment of the present invention. FIG. 22 is a block diagram showing a control section incorporated in this manual control unit, and FIG. 23 is a flow chart showing a control process to be executed when a stretch (continuous) button of the manual control unit is selected.

The manual control unit 80 is equipped in the aforementioned foot massaging apparatus 1, 11, 21, 31, 41, 51, 61 or 71. The manual control unit 80 has a button 81 for rotating the rotatable roller unit forward (a direction allowing an upper portion of the rotatable roller unit to be moved forward), a button 82 for rotating the rotatable roller unit backward (a direction allowing the upper portion of the rotatable roller unit to be moved backward), a button 83 for charging air into the air cells, a button 84 for discharging the air from the air cells, a button 85 for performing a (continuous) stretching operation, a button 86 for performing a (intermittent) stretching operation, and a button 87 for turning on and off a power supply. While the foot massaging apparatus 1 according to the first embodiment is shown in FIG. 21 as a main body of the foot massaging apparatus according to the ninth embodiment, it may be any one of the foot massaging apparatus 11 to 71.

The control section incorporated in the manual control unit 80 comprises a rotation control section 88 for controlling a rotational of the rotatable roller unit, and an air control section 89 for controlling the charge and discharge of air to/from the air cells, and serving as a detector for detecting that an air pressure in the air cells reaches a predetermined value, and the toe-region pinching unit pinches user's toe region.

The air control section 89 is operable, in response to pushing the button 83, to instruct to charge air into the air cells 6, and, in response to pushing the button 84, to instruct to discharge the air from the air cells 6. The air control section 89 is also operable, in response to pushing the button 85 or 86, to instruct to charge air into the air cells 6 and then automatically discharge the air from the air cells after a lapse of a given time-period.

The rotation control section 88 is operable, in response to pushing the button 81, to instruct to rotate the rotatable roller unit 3 forward, and, in response to pushing the button 82, to instruct to rotate the rotatable roller unit 3 backward. The term "forward rotation" herein means a rotational direction allowing a portion of the rotatable roller unit 3 located at an uppermost position at a certain timing to be moved forward, and the term "backward rotation" herein means the opposite rotational direction of the forward rotation. When the button 85 or 86 is pushed, the rotation control section 88 enters in a standby state without immediately instructing to activate the rotatable roller unit 3. Then, after the air control section 87 detects that an air pressure in the air cell 6 reaches a predetermined value, the rotation control section 88 is operable, in response to receiving the detection signal, to instruct to rotate the rotatable roller section 3 backward and automatically stop the rotation after a lapse of a given time-period.

A control process to be executed when the button 85 in the manual operation unit 85 is pushed, or in the (continuous) stretching operation, will be described below.

As shown in FIG. 23, the air control section 89 firstly instructs to charge air into (an air pressure is increased in) the air cells (Step S1), and detects whether the air pressure reaches a predetermined value (Step S2). When the air control section 89 detects that the air pressure reaches the predetermined value, it sends a detection signal to the rotation control section 88, and instructs to maintain the air pressure.

Then, in response to the detection signal, the rotation control section 88 instructs to initiate a backward rotation in the rotatable roller unit (Step S3), and determines whether a given time has elapsed (Step S4). When the rotation control section 88 determines that the given time has elapsed, it instructs to stop the rotation of the rotatable roller unit (Step S5). As above, after the lapse of the given time-period from the time when the air pressure reaches the predetermined value, the air control section 89 instructs to automatically discharge the air from the air cells. For example, the timing of the air discharge is set at the same time as or a time later than that when the rotation the rotatable roller unit is stopped.

As above, as shown in FIGS. 24A and 24B, in the ninth embodiment, when the detector (air control section 89) detects that the toe-region pinching unit 4 pinches the toe region, the rotation control section 88 instructs to rotate the rotatable roller unit backward. Thus, as shown in FIG. 25, the foot having the toe region pinched by the toe-region pinching unit 4 is puller backward (Y direction) by the rotatable roller unit 3 which is being rotated backward (X direction). This allows the toe region to have a stretching massage.

When the button 86 is pushed to perform the (intermittent) stretching operation, the air control section performs the same control as that to be executed when the button 85 is pushed, and the rotation control section 88 instructs to rotate the rotatable roller unit intermittently. In this case, an intermittent repeated stretching massage can be performed.

As described above, an inventive foot massaging apparatus comprises a housing for supporting user's foot, a rotatable roller unit mounted on the housing, and a toe-region pinching unit mounted on the housing and located in front of the rotatable roller unit. The toe-region pinching unit has an air cell adapted to be inflated and deflated, respectively, by charging and discharging air thereto and therefrom, so as to repeatedly pinch the toe region of the user's foot.

In the foot massaging apparatus, the toe-region pinching unit may be mounted on the housing in at least one manner selected from the group consisting of: slidable in a lateral direction of the housing; slidable in a forward/backward direction of the housing; swingable around a horizontal axis; and swingable around a vertical axis.

In the foot massaging apparatus, the toe-region pinching unit may be mounted on the housing in a manner that it is swingably moved around a horizontal axis so as to be retractable into and extractable out of the housing, or in a detachable manner through an attaching/detaching mechanism operatively associated between the toe-region pinching unit and the housing.

In the foot massaging apparatus, the toe-region pinching unit may be mounted on the housing in a manner that it is swingably moved around a horizontal axis to reverse top and bottom surfaces thereof so as to allow the reversed upward-facing bottom surface to serve as a footrest.

The foot massaging apparatus may further include a detector for detecting that the toe-region pinching unit pinches the toe region of the user's foot, and a rotation controller operable, when the detector detects that the toe-region pinching unit pinches the toe region, to allow the rotatable roller unit to be rotated in a backward direction.

The foot massaging apparatus comprises the rotatable roller unit mounted on the housing, and the toe-region pinching unit having the air cell adapted to be inflated and deflated, respectively, by charging and discharging air thereto and therefrom, is mounted on the housing and located in front of the rotatable roller unit. Specifically, when an air is supplied to the air cell of the toe-region pinching unit located in front of the rotatable roller unit, the air cell is inflated to allow the toe-region pinching unit to pinch the toe region inserted thereinto. Then, when the air is discharged from the air cell, the air cell is deflated to come free from the toe region. Thus, the foot massaging apparatus allows the rotatable roller unit to repeatedly perform a pressing operation for the foot or other leg region of a user while allowing the toe-region pinching unit to perform a massaging operation for the toe region of the user, so as to prevent the user from getting bored.

The toe-region pinching unit may be mounted on the housing in at least one manner selected from the group consisting of: slidable in a lateral direction of the housing; slidable in a forward/backward direction of the housing; swingable around a horizontal axis; and swingable around a vertical axis. In this case, the toe-region pinching unit can be slid in a lateral direction of the housing to adjust a position of the toe-region pinching unit depending on a distance between user's right and left feet, or can be slid in a forward/backward direction of the housing to adjust a position of the toe-region pinching unit depending on user's foot size, or can be swung around a horizontal axis to allow user's toe region to be readily inserted thereinto, or can be swung around a vertical axis to cope with a user whose toes point outward relative to the heel region or a user whose toes point inward relative to the heel region.

The toe-region pinching unit may be mounted on the housing in a manner that it is swingably moved around a horizontal axis so as to be retractable into and extractable out of the housing, or in a detachable manner through an attaching/detaching mechanism operatively associated between the toe-region pinching unit and the housing. In this case, the toe-region pinching unit can be swung around a horizontal axis in such a manner as to be retracted into stored in the housing for the purpose of storing or extracted out of the housing for the purpose of use. The toe-region pinching unit can also detached from the housing through a detaching operation of the attaching/detaching mechanism, or can be attached for the purpose of use through an attaching operation of the attaching/detaching mechanism.

The toe-region pinching unit may be mounted on the housing in a manner that it is swingably moved around a horizontal axis to reverse top and bottom surfaces thereof so as to allow the reversed upward-facing bottom surface to serve as a footrest. In this case, after the toe-region pinching unit is swung around a horizontal axis to allow the bottom surface thereof to face upward so as to serve as a footrest, a user can have a massage for his/her calf region while placing his/her foot on the footrest.

The foot massaging apparatus may further include a detector for detecting that the toe-region pinching unit pinches the toe region of the user's foot, and a rotation controller operable, when the detector detects that the toe-region pinching unit pinches the toe region, to allow the rotatable roller unit to be rotated in a backward direction. In this case, when the detector detects that the toe-region pinching unit pinches the toe region, the rotatable roller unit is rotated in a backward direction by the rotation controller. Thus, the rotatable roller unit pulls the foot having the toe region pinched by the toe-region pinching unit, backward so as to allow the toe region to have a stretching massage.

Advantageous embodiments of the invention have been shown and described. It is obvious to those skilled in the art that various changes and modifications may be made therein without departing from the spirit and scope thereof as set forth in appended claims.

The present disclosure relates to subject matter contained in Japanese Patent Application No. 2004-241361, filed on Aug. 20, 2004, the contents of which are herein expressly incorporated by reference in its entirety.

What is claimed is:

1. A foot massaging apparatus comprising:

a housing configured to support a user's foot;

a rotatable roller unit mounted on said housing; and a toe-region pinching unit mounted on said housing and located in front of said rotatable roller unit, said toe-region pinching unit having at least one air cell configured to be inflated and deflated, and an air charger/discharger configured to inflate and deflate respectively, the at least one air cell by charging and discharging air thereto and therefrom, so as to repeatedly pinch the toe region of the user's foot when a massage is being performed.

2. The foot massaging apparatus according to claim 1, further comprising:

a detector for detecting that the toe-region pinching unit pinches the toe region of the user's foot; and a rotation controller operable, when said detector detects that said toe-region pinching unit pinches said toe region, to allow said rotatable roller unit to be rotated in a backward direction.

3. The foot massaging apparatus according to claim 1, wherein said toe-region pinching unit is mounted on said housing so as to be at least one of slidable in a lateral direction of said housing; slidable in a forward/backward direction of said housing; swingable around a horizontal axis; and swingable around a vertical axis.

4. The foot massaging apparatus as defined in claim 3, further comprising:

a detector for detecting that said toe-region pinching unit pinches the toe region of the user's foot; and a rotation controller operable, when said detector detects that said toe-region pinching unit pinches said toe region, to allow said rotatable roller unit to be rotated in a backward direction.

5. The foot massaging apparatus according to claim 1, wherein said toe-region pinching unit is mounted on said housing so as to be swingably moveable about a horizontal axis so as to be retractable into and extractable out of said housing, or in a detachable manner through an attaching/detaching mechanism operatively associated with said toe-region pinching unit and with said housing.

6. The foot massaging apparatus as defined in claim 5, further comprising:

a detector for detecting that said toe-region pinching unit pinches the toe region of the user's foot; and a rotation controller operable, when said detector detects that said toe-region pinching unit pinches said toe region, to allow said rotatable roller unit to be rotated in a backward direction.

7. The foot massaging apparatus according to claim 1, wherein said toe-region pinching unit is mounted on said housing so as to be swingably moveable about a horizontal axis to reverse top and bottom surfaces of said toe region pinching unit of so as to allow the reversed upward-facing bottom surface to serve as a footrest.

8. The foot massaging apparatus as defined in claim 7, further comprising:

a detector for detecting that said toe-region pinching unit pinches the toe region of the user's foot; and a rotation controller operable, when said detector detects that said toe-region pinching unit pinches said toe region, to allow said rotatable roller unit to be rotated in a backward direction.

9. The foot massaging apparatus according to claim 1, wherein said rotatable roller unit includes a left portion for allowing the user to place a user's left foot thereon and a right portion for allowing the user to place a user's right foot thereon.

10. The foot massaging apparatus according to claim 9, wherein said toe-region pinching unit includes a pair of left and right toe-region pinching units, said left toe-region pinching unit is disposed in front of said left portion, and said right toe-region pinching unit is disposed in front of said right portion.

11. The foot massaging apparatus according to claim 1, wherein said toe-region pinching unit has an opening at a rear portion of said toe-region pinching unit for allowing the user to insert the user's toe region into said toe-region pinching unit.

12. The foot massaging apparatus according to claim 11, wherein said toe-region pinching unit is configured to have a V shape cross-section with the opening at the rear end.

13. The foot massaging apparatus according to claim 1, wherein said toe-region pinching unit includes a pair of air cells respectively attached to upper and lower surfaces that define an inner space of said toe-region pinching unit.

14. The foot massaging apparatus according to claim 13, wherein said toe-region pinching unit includes a roof wall having said upper surface, and opposite right and left side walls extending vertically downward respectively, from right and left ends of said roof wall.

15. The foot massaging apparatus according to claim 1, wherein said at least one air cell is attached to said housing with a cushioning material.

16. A foot massage apparatus comprising:

a housing configured to support at least a portion of a foot;

a rotatable roller unit mounted on the housing;

a toe region pinching unit mounted on the housing and located in front of the rotatable roller unit, the toe region pinching unit including an air cell configured to be inflated and deflated by charging air thereto and by discharging air therefrom, so as to repeatedly pinch a toe region of the foot;

a detector configured to detect that the toe region of the foot contacts the toe region pinching unit; and a rotation controller configured to control the rotatable roller unit to rotate in a predetermined direction, when the detector detects that the toe region of the foot contacts the toe region pinching unit.

17. A foot massaging apparatus comprising:

a housing configured to support a user's foot;

a rotatable roller unit mounted on said housing;

a toe-region pinching unit mounted on said housing and located in front of said rotatable roller unit, said toe-region pinching unit having an air cell adapted to be inflated and deflated, respectively, by charging and discharging air thereto and therefrom, so as to repeatedly pinch a toe region of the user's foot;

a detector for detecting that said toe-region pinching unit pinches the toe region of the user's foot; and a rotation controller operable, when said detector detects that said toe-region pinching unit pinches said toe region, to allow said rotatable roller unit to be rotated in a backward direction.

18. The foot massaging apparatus according to claim 17, wherein said toe-region pinching unit is mounted on said housing so as to be at least one of slidable in a lateral direction of said housing, slidable in a forward/backward direction of said housing, swingable around a horizontal axis, and swingable around a vertical axis.

19. The foot massaging apparatus according to claim 17, wherein said toe-region pinching unit is mounted on said housing so as to be swingably movable around a horizontal axis so as to be retractable into and extractable out of said housing, or in a detachable manner through an attaching/detaching mechanism operatively associated with said toe-region pinching unit and with said housing.

20. The foot massaging apparatus according to claim 17, wherein said toe-region pinching unit is mounted on said housing so as to be swingably movable around a horizontal axis to reverse top and bottom surfaces of aid toe region pinching unit so as to allow the reversed upward-facing bottom surface to serve as a footrest.

* * * * *

UNITED STATES PATENT AND TRADEMARK OFFICE

CERTIFICATE OF CORRECTION

PATENT NO. : 7,575,560 B2
APPLICATION NO. : 11/236497
DATED : August 18, 2009
INVENTOR(S) : A. Mizuuchi et al.

It is certified that error appears in the above-identified patent and that said Letters Patent is hereby corrected as shown below:

At column 14, line 5 (claim 7, line 5), delete "of" before so.

Signed and Sealed this

Twenty-third Day of March, 2010

David J. Kappos

David J. Kappos
*Director of the United States Patent and Trademark Office*